US007032419B2

(12) United States Patent
Booker

(10) Patent No.: US 7,032,419 B2
(45) Date of Patent: Apr. 25, 2006

(54) RETRACTABLE SILENT KEY HOLDER

(76) Inventor: Bruce Wayne Booker, P.O. Box 263, Carbondale, IL (US) 62903-0263

( * ) Notice: Subject to any disclaimer, the term of this patent is extended or adjusted under 35 U.S.C. 154(b) by 0 days.

(21) Appl. No.: 10/838,980

(22) Filed: May 5, 2004

(65) Prior Publication Data

US 2005/0247089 A1 Nov. 10, 2005

(51) Int. Cl.
*A47G 29/10* (2006.01)

(52) U.S. Cl. ..... 70/456 R; 206/37.1

(58) Field of Classification Search ..... 70/456 R, 70/457, 459, 456 B; 206/37.1–37.9; D3/207–212
See application file for complete search history.

(56) References Cited

U.S. PATENT DOCUMENTS

| | | | | | |
|---|---|---|---|---|---|
| 3,354,678 | A | * | 11/1967 | Stifelman | 70/456 R |
| 3,407,636 | A | * | 10/1968 | Kovacevic | 70/456 R |
| 3,680,338 | A | * | 8/1972 | Lee | 70/456 R |
| 3,765,200 | A | * | 10/1973 | Vogt | 70/456 R |
| 4,245,486 | A | | 1/1981 | Matsumoto | |
| 4,354,368 | A | * | 10/1982 | Toyoda | 70/456 R |
| 4,440,011 | A | * | 4/1984 | Klein | 70/456 R |
| 4,569,215 | A | * | 2/1986 | McCarthy | 70/456 R |
| 4,641,125 | A | | 2/1987 | Pesa | |
| 4,901,549 | A | * | 2/1990 | Dengel | 70/456 R |
| D309,373 | S | | 7/1990 | Appelbaum | |
| 5,077,994 | A | * | 1/1992 | Trull et al. | 70/224 |
| 5,117,666 | A | * | 6/1992 | Keefer | 70/456 R |
| 5,123,579 | A | | 6/1992 | Sugiyama | |
| 5,168,984 | A | * | 12/1992 | Walsh | 70/456 R |
| 5,177,989 | A | | 1/1993 | Stillwagon | |
| 5,199,560 | A | | 4/1993 | Lee | |
| 5,487,291 | A | * | 1/1996 | Voigt | 70/456 R |
| 6,106,131 | A | | 8/2000 | Hao | |
| 6,237,756 | B1 | * | 5/2001 | Caudle | 70/456 R |

* cited by examiner

*Primary Examiner*—Brian E. Glessner
*Assistant Examiner*—Christopher Boswell
(74) *Attorney, Agent, or Firm*—Polster, Lieder, Woodruff & Lucchesi, L.C.

(57) ABSTRACT

A retractable key holder having an external housing and an internal housing pivotably secured at least partially within the external housing by pivot pins, a retractable transverse spring biased pin that extends through substantially vertically aligned slots formed in the external and internal housing, an actuator button on each end of the retractable pin and positioned outside the external housing for access by a user, and a key ring attached to the spring biased pin. The user can retract keys secured on the key ring into the internal housing by retracting the retractable pin along the length of the slots and pivot the internal housing within external housing until the keys engage a sound buffering material within the external housing disposed to press against keys to prevent rattling of the retracted keys.

7 Claims, 5 Drawing Sheets

RETRACTABLE SILENT KEY HOLDER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to key holders, and specifically to a new type of a retractable key holder.

2. Prior Art

One problem with standard key chains is that the keys tend to rattle and also to become disarrayed. Therefore, several inventions have been made of retractable key chains or key holders. U.S. Pat. No. 5,199,560 to Lee et al, (1993), comprises a retractable key holder in which the keys are sandwiched between two covers and are attached to the key holder by an articulated joint or pin. The Lee invention holds the keys in extended or retracted position by employing a leaf spring, somewhat similar in design to a pocket knife, except with keys in the place of blades.

U.S. Pat. No. 5,123,579 to Sugiyama (1992), also comprises a key holder with the keys sandwiched between two sides of the holder, and articulated by a pin in order to be capable of swiveling partially out of the case for use. Both the Sugiyama and the Lee patents reduce the rattling of keys held in such a case. However, the Sugiyama and Lee patents have a drawback, in that removing a key out of the case, or adding a key, presents a significant difficulty. Additionally, besides substituting one key for another, adding or reducing the number of keys in the holder would also present a significant difficulty. Both the Sugiyama and Lee patents appear to be designed to hold only a very small number of keys.

Another approach to designing a retractable key holder is represented by U.S. Pat. No. 5,177,989 to Stillwagon (1993), that comprises a key holder consisting of two sides that are hinged at the top. The sides can swivel outward to permit access to the keys held within. However, the Stillwagon patent does not appear to have any method to reduce rattling of keys other than closing the case on the keys. One problem with this method is that not all keys are the same size, and while a larger key may be held snugly between the two sides of the case, a smaller key may rattle in the remaining space. Thus with the Stillwagon patent, the user is facing a dilemma, in that if there is too much space in the key case, the keys will rattle, but if there is not enough space for the keys, the case may not be able to be closed. Also, a key case that opens by the use of a hinge to expose the key contents, such as the Stillwagon Patent, is unwieldy and likely to cause disarray of keys upon opening.

Another key holder, consisting of a case with two sides, which swivel open at one end, is U.S. Pat. No. 6,106,131 to Hao (2000). Like the Stillwagon patent, the Hao Patent has the drawback that, if there is extra room in the key holder, the keys will tend to rattle.

U.S. Pat. No. 4,245,486 to Matsumoto et al., (1981), is a retractable charm device, that can serve as a retractable key holder. However, the Matsumoto device is designed to be worn as a necklace, or attached to clothing, and does not contemplate a retractable key holder for use in pocket or purse. The Matsumoto patent has no feature to prevent rattling of keys.

U.S. Pat. D309,373 to Applebaum, (1990), is a retractable key holder, but it has no feature to prevent or reduce the rattling of keys. Similarly, U.S. Pat. No. 4,641,125 to Pesa, (1987) is a retractable key holder, that has no feature to prevent the rattling or disarray of keys.

SUMMARY

This invention is a retractable key holder. This key holder makes use of an external housing, and an internal housing that tilts relative to the external housing. Keys are retracted into the internal housing, which then can be tilted to a position that will hold the keys against a plug of soft material, in order to dampen the movement of, and reduce the noise of, rattling keys.

Objects and Advantage

Accordingly, several objects and advantages of my invention are:

a. A key holder that will smoothly retract keys into itself.

b. A key holder which will dampen the rattling of keys, when the keys held in a retracted position.

c. A key holder of a generally rounded outer configuration, without sharp angles, and compact, so that it may be smoothly placed into a pocket or purse, or removed there from, with little likelihood of snagging the material of the pocket or purse, when the keys are in the retracted position.

d. The use of an internal housing with a pivot point, to control the position of keys as they are retracted.

e. A key holder which allows the easy substitution of keys, or adding or subtracting of keys, by means of a simple key ring keeper incorporated into a retractable key holder.

Further objects and advantages of my invention will become apparent from the drawings and consideration of the ensuing description.

DRAWING FIGURES

Figure 1:
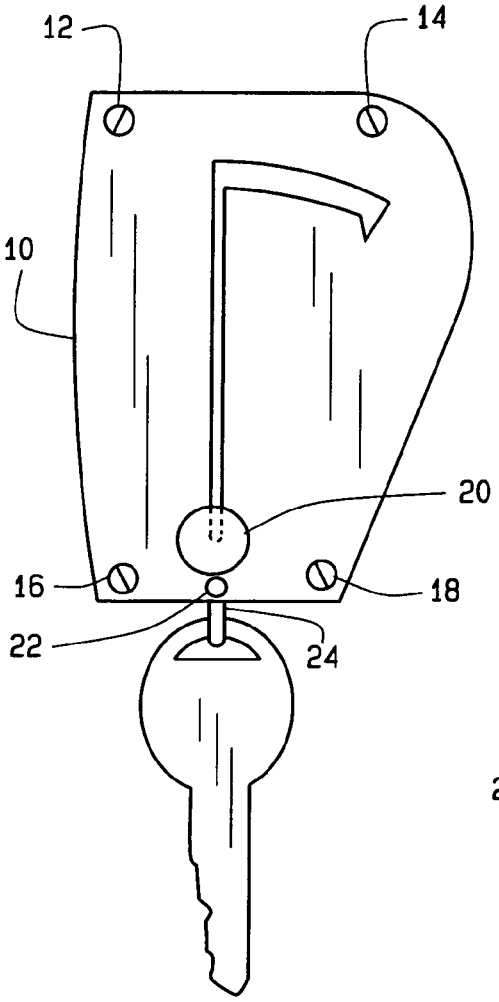
FIG. 1 is a front view of my invention, in extended position.

LIST OF REFERENCE NUMERALS:

10 front outer housing

12 top left screw

14 top right screw
16 bottom left screw
18 bottom right screw
20 front button
22 front pivot pin
24 keeper
26 front inner housing
28 plug
30 front spring
32 button pin
34 rear outer housing
36 rear button
38 rear inner housing
40 rear pivot pin
42 rear spring

DESCRIPTION OF INVENTION, MAIN EMBODIMENT

A key holder capable of retracting keys within itself. The following parts are all visible in FIGS. 8 and 9. Button pin 32 transfixes keeper 24. Front inner housing 26, and rear inner housing 38, are held together by glue, at their adjoining edges, and are transfixed by button pin 32. Button pin 32 also transfixes front outer housing 10, and rear outer housing 34. Between the inner and outer housings, button pin 32 transfixes the top of front spring 30 and rear spring 42. Also between the outer and inner housings are front pivot pin 22, and rear pivot pin 40. The bottom portion of front inner housing 26 is attached to front outer housing 10, by front pivot pin 22. The bottom of rear inner housing 38 is attached to rear outer housing 34, by pivot pin 40. Front spring 30 is attached to both front pivot pin 22, and button pin 32. Rear Spring 42 is attached to rear pivot pin 40, and button pin 32. Top left screw 12, top right screw 14, bottom left screw 16 and bottom right screw 18, hold together front outer housing 10 and rear outer housing 34, and insert into threaded holes in front outer housing 10, and back outer housing 34. Plug 28, is held against the inside surfaces of front outer housing 10, and rear outer housing 34, by glue. Front button 20 and rear button 36 are held onto button pin 32 by glue or threads.

Operation of Invention

Figure 2:
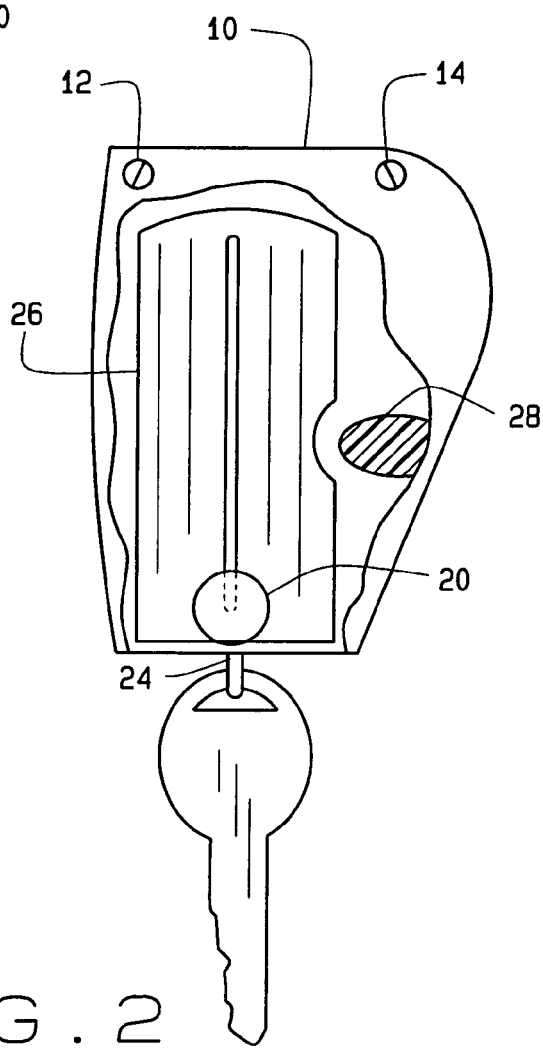
FIG. 2 is a partial cut away front view of my invention, in extended position.
Figure 3:
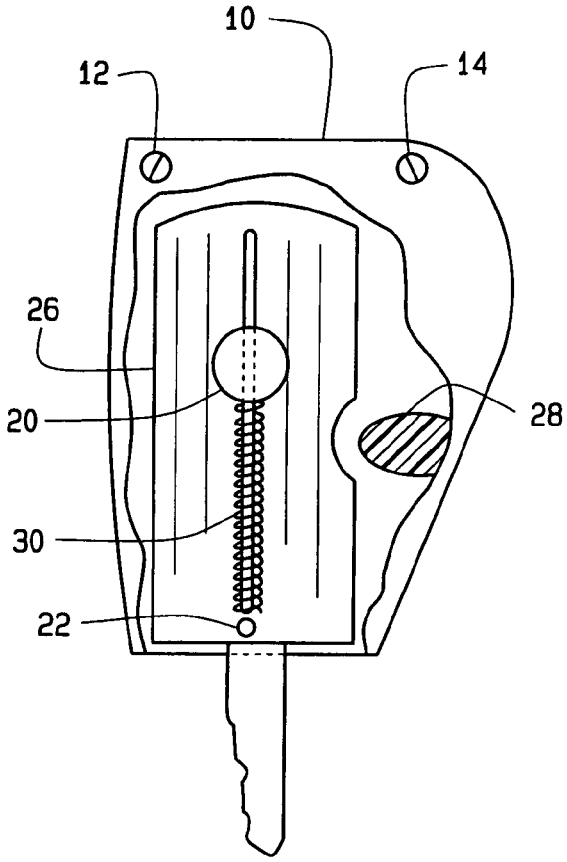
FIG. 3 is a partial cut away front view of my invention, in a partially retracted position.
Figure 8:
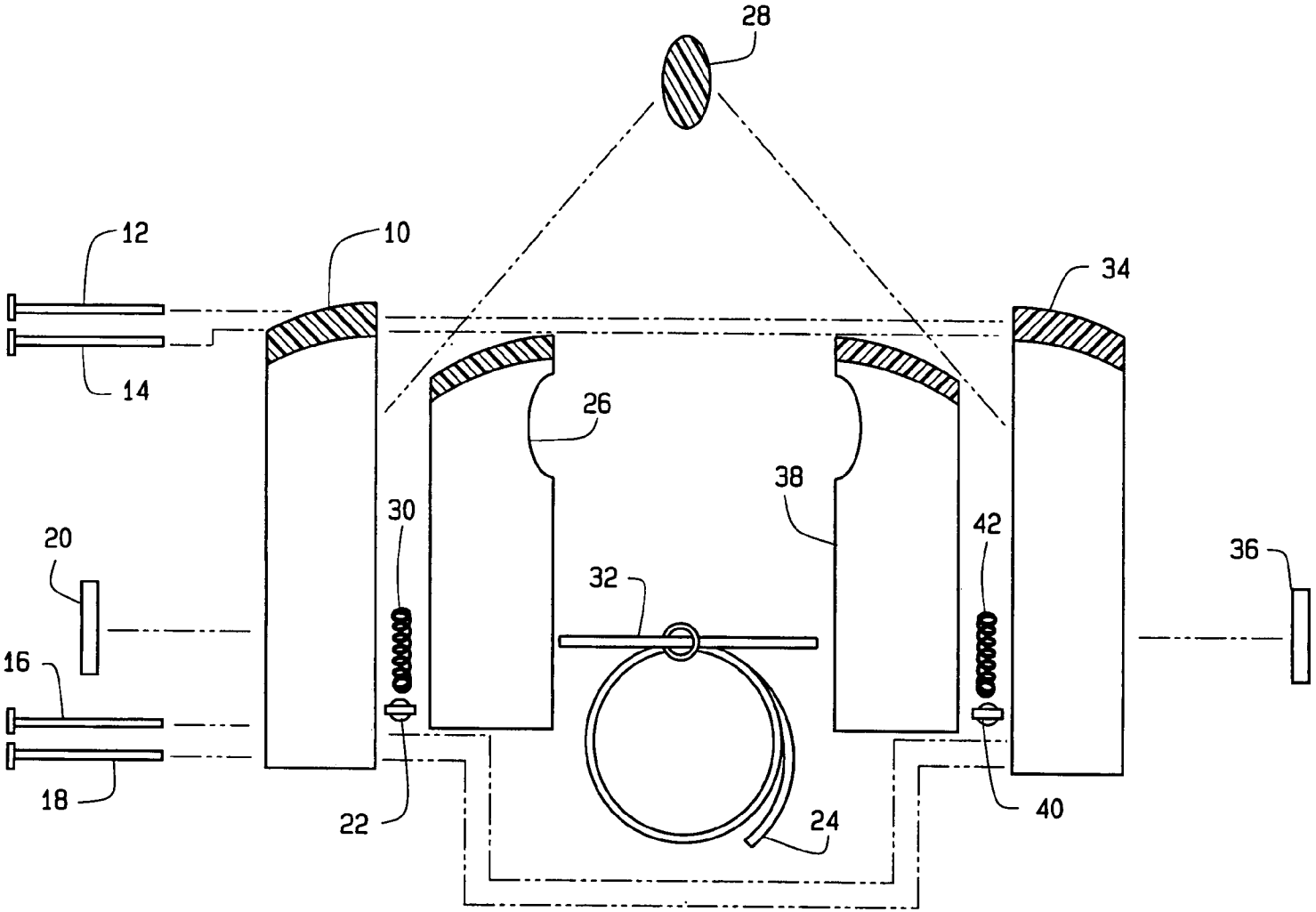
FIG. 8 is an exploded profile view of my invention.
Figure 9:
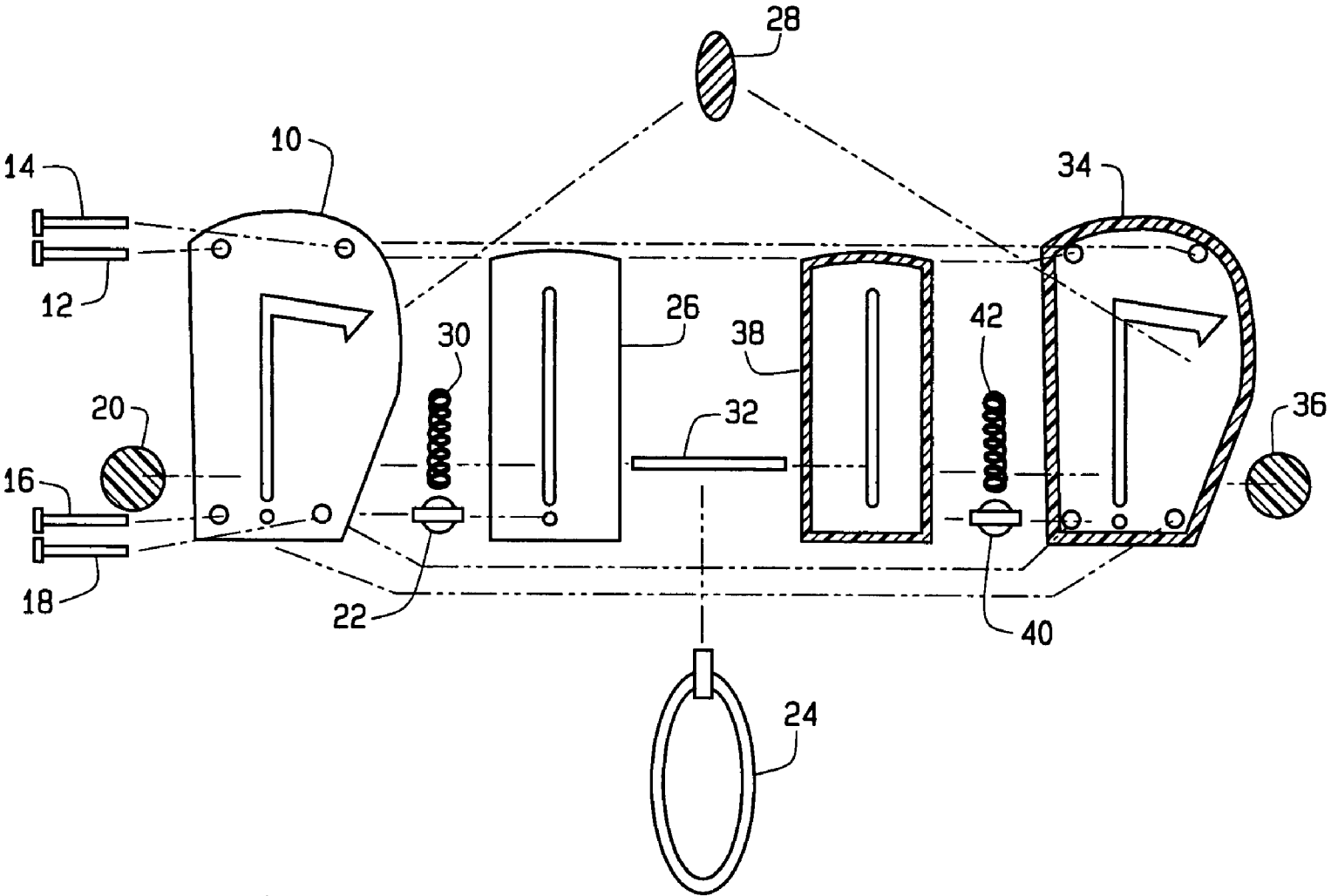
FIG. 9 is an exploded perspective view of my invention.

All of the referenced parts are visible in FIGS. 8 and 9. Beginning in the extended position, that is, with the keeper partially outside the external housing, and any keys on the keeper outside the external housing, (see FIG. 1), the operation of the invention is as follows. FIG. 2 is a partial cut away view, exposing the front inner housing, 26, and plug, 28 while the key holder is in the extended position. The user grasps the front button 20 and the rear button 36, and pulls them upward. As buttons 20 and 36 move upward, so does the button pin 32, which connects front button 20 and rear button 36. Button pin 32 transfixes a small loop at the top of keeper 24. Consequently, as front button 20 and rear button 36 are pulled up, keeper 24 is pulled up into the interior housing, made up of front inner housing 26, and rear inner housing 38. Front spring 30 stretches between button pin 32 and front pivot pin 22. Rear spring 42, stretches between button pin 32, and rear pivot pin 40. Therefore, as the button pin 32, and keeper 24, move upward, front Spring 30, and rear spring 42, are stretched. FIG. 3 illustrates a partial cut away view of the invention with a key partially retracted into the inner housing.

Figure 5:
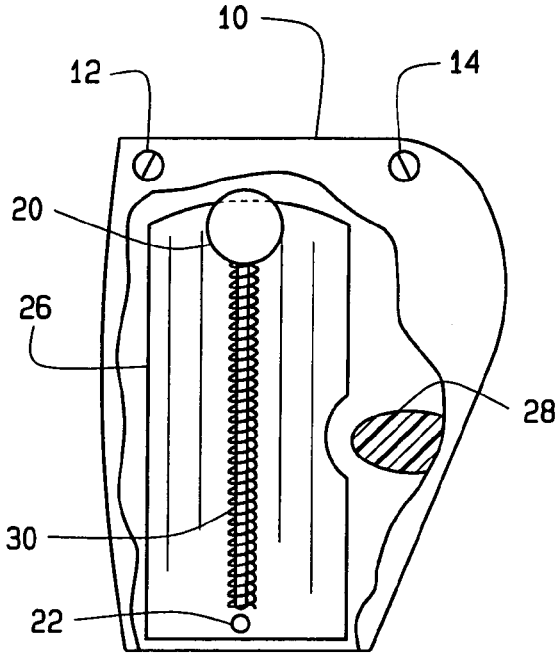
FIG. 5 is a partial cut away front view of my invention, in a retracted position.

As the front button 20, and back button 36, button pin 32, and keeper 24, are retracted, button pin 32 slides along a vertical slots in front inner housing 26, and rear inner housing 38 (slots are visible in FIG. 9). Simultaneously button pin 32 slides along the vertical portion of the slot in front outer housing 10, and the slot in rear outer housing 34 (slots are visible in FIG. 9). FIG. 5 is a partial cut away view of the invention, with the keeper and any attached keys fully retracted into the internal housing, made up of front internal housing 26, and rear internal housing 38. If the user were to release the front button 20, and rear button 36, when the invention is in the retracted position, shown in FIG. 5, the keys and keeper 24 would simply return to extended position (shown in FIG. 1), along with front button 20 and rear button 36, and button pin 32.

Figure 4:
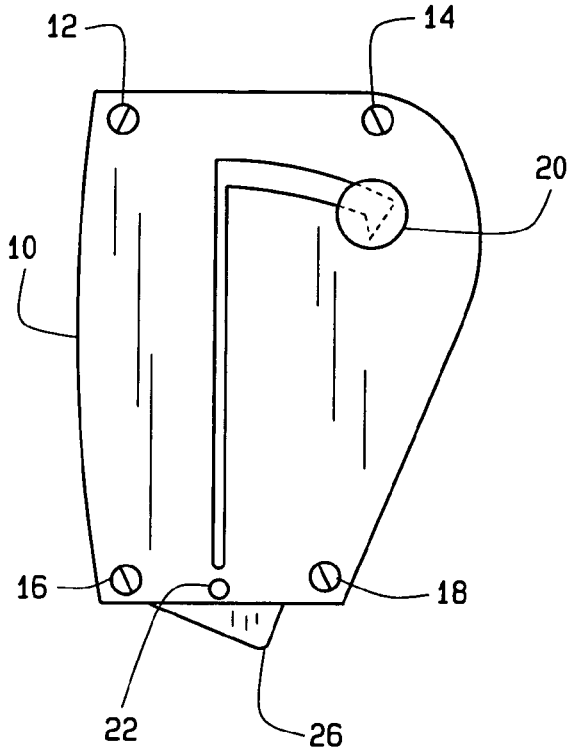
FIG. 4 is a front view of my invention in retracted position.
Figure 6:
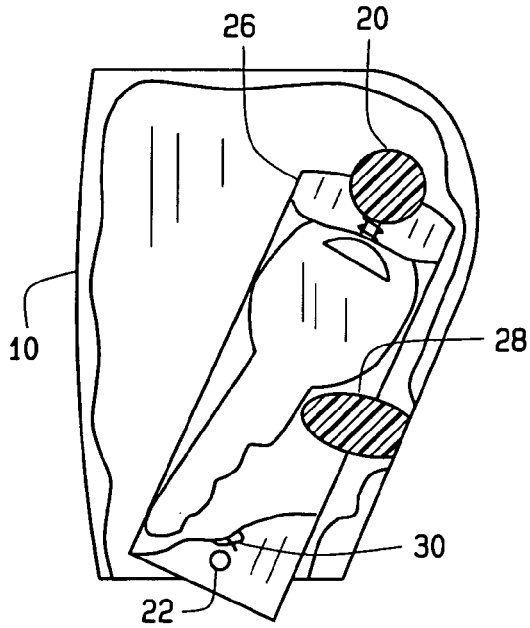
FIG. 6 is a cutaway front view of my invention in fully retracted position.
Figure 7:
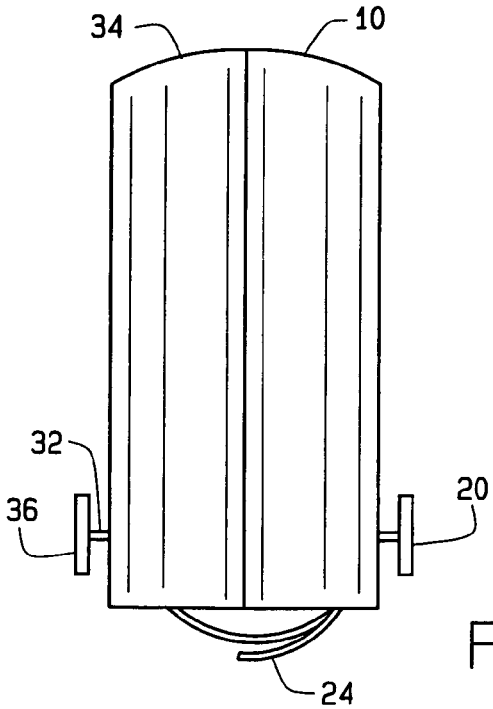
FIG. 7 is a profile view of my invention, in extended position, without keys.

If the user wishes for the keys and keeper 24 to remain retracted, the user must move the key holder into retracted and locked position. To reach retracted and locked position, the user moves front button 20, and rear button 36, to the side along the horizontal portion of the slots in front outer housing 10, and back outer housing 34. FIG. 4 is a view of my key holder in retracted and locked position. FIG. 6 is a cut away view of my invention in retracted and locked position, showing a key inside the front internal housing, 26, which is in turn, inside the front external housing, 10. FIG. 1, and also FIG. 4, show the vertical and horizontal portions of the slot in front outer housing 10. An identical slot exists in back outer housing 34, as shown in FIG. 9. The horizontal portion of the slot in front outer housing 10, and back outer housing 34, slants slightly downward and terminates in a notch, thus using the tension of front spring 30 and back spring 42, to hold button pin 32 into the retracted and locked position.

The front button 20, back button 36, and button pin 32, move together along the horizontal portion of the slot in front outer housing 10, and back outer housing 34. Simultaneously, the inner housing, made up of front inner housing 26, and back inner housing 38, pivots at the points of front pivot pin 22, and back pivot pin 40. When buttons 20 and 36, along with button pin 32, reach the notch at the end of the horizontal portion of the slots in front outer housing 10 and rear outer housing 34, this is the retracted and locked position. The retracted and locked position is shown in FIG. 4, and FIG. 6. In the retracted and locked position, the top of the internal housing, (made up of front inner housing 26 and back inner housing 38), are close to the side of the outer housing, made of front outer housing 10, and back outer housing 34. Plug 28 is fixed to the inside of front outer housing 10, and back outer housing 34.

As the inner housings, 26 and 38, moves into retracted and locked position; plug 28 passes through a hole in the side of the front inner housing, 26, and back inner housing 38, as shown in FIG. 6. The function of plug 28, which is made of a soft, yet resilient material, is to press against any keys in the inner housing, thus stopping, or limiting the movement of any such keys. Plug 28 is made of a resilient material, such as soft rubber, that can deform while in contact with the keys in the key holder, in order to accommodate different sizes and shapes of keys. Plug 28 is also designed to return to more or less its original shape when not in contact with the keys.

The user may next return the invention to extended position, shown in FIGS. 1 and 2, from retracted and locked position, as shown in FIGS. 4 and 6. To return the key holder to extended position, the user simply grasps front button 20, and back button 36, and moves them to the top of the vertical portion of the slots in front outer housing 10, and back outer housing 34, as shown in FIG. 5. By moving the buttons, 20 and 36, the user moves button pin 32, and rotates the front inner housing 26, and back inner housing 38, to the position shown in FIG. 5. When the front inner housing 26, and back inner housing 38, have reached the position indicated in FIG. 5, the plug, 28, is no longer in contact with any keys that are in the key holder. Also, when the front inner housing 26, and back inner housing 38, have reached the position shown in FIG. 5, plug 28 is no longer in contact with front inner housing 26, and back inner housing 38. Once the invention is in the position of FIG. 5, the user simply releases front button 20, and back button 36, then the tension of front spring 30, and back spring 42, pulls button pin 32, front button 20, back button 36, keeper 24, and any keys on keeper 24, back to the extended position as shown in FIGS. 1 and 2.

Conclusions, Ramifications, and Scope

Thus the reader will see that the invention provides a highly reliable, lightweight, yet economical device that can be used by persons of almost any age. While my above description contains many specificities, these should not be construed as limitations on the scope of the invention, but rather as an exemplification of one preferred embodiment thereof. Many other variations are possible. For example:

The key holder may be made of different materials, as long as the dampening plug is made of a soft material, the rest of the invention may be made of plastic or metal, held together with metal, or plastic screws, or glue.

The invention may be made all of metal, or wood, or other suitable material, or any combination thereof.

The invention could be configured to hold tuning keys, or magnetic keys, or any other object of approximately the size of a key, that may rattle if not held by the unique mechanism of this invention.

The invention may be made in a larger version, for use by caretakers, or those of any profession requiring the use of a large number of keys, configured to be secured to a belt, rather then placed into a pocket or purse.

Accordingly, the scope of the invention should be determined not by the embodiments illustrated, but by the appended claims and their legal equivalents.

The invention claimed is:

1. A key holder, comprising:

(a) an external housing;

(b) an internal housing, (c) means for pivotably mounting said internal housing inside said external housing;

(d) means by which keys can be retracted into said internal housing (e) means by which keys can be extended out of said internal housing while said internal housing remains within said external housing;

(f) means by which said internal housing can be rotated in relation to said external housing when the keys are retracted into said internal housing ;and (g) means by which keys can be held under pressure while in a retracted position inside said internal housing comprising a plug of soft material; whereby the key holder allows the smooth retraction of keys into itself, and whereby the key holder dampens the rattling of keys held in a retracted position by being held under pressure while in a retracted position inside said internal housing.

2. The key holder of claim 1 wherein said means for pivotably mounting said internal housing at least partially inside said external housing further comprises at least one pivot pin.

3. The key holder of claim 1 wherein said means by which said keys can be retracted inside said internal housing further comprise at least one button positioned external to the external housing and connected to a keeper by a retractable button pin.

4. The key holder of claim 1 further comprising means by which said keys may be held in a retracted position.

5. The key holder of claim 1 further comprising urging means to assist in returning said keys to an extended position.

6. The key holder of claim 1 wherein said key holder is of a generally rounded shape.

7. A holder for keys, comprising:

(a) an external housing;

(b) an internal housing;

(c) at least one pivot pin that pivotably mounts said internal housing at least partially inside said external housing;

(d) a retractable button pin which transects said external housing and said internal housing. said external housing and said internal housing each having complementary slots formed therein in which said button pin is slidably mounted, (e) a keeper connected to said button pin, (f) at least one button mounted at an end of said button pin outside of the external housing;

(g) at least one spring extending between said at least one pivot pin and said button pin;

(h) a plug of soft material within said external housing disposed to be pressed against keys while keys are in a retracted position inside said internal housing when said internal housing is pivoted within said external housing; and (i) means for allowing extension of keys outside the external housing for use while said internal housing remains inside said external housing;

whereby said key holder allows the smooth retraction of keys into itselt, and whereby said soft material dampens the rattling of keys held in a retracted position.

* * * * *